US007266851B1

(12) United States Patent
Batalini

(10) Patent No.: US 7,266,851 B1
(45) Date of Patent: Sep. 11, 2007

(54) FOOT SUPPORT

(76) Inventor: Renee A. Batalini, 1991 SE. Giffen Ave., Port Saint Lucie, FL (US) 34952

( * ) Notice: Subject to any disclaimer, the term of this patent is extended or adjusted under 35 U.S.C. 154(b) by 0 days.

(21) Appl. No.: 11/533,606

(22) Filed: Sep. 20, 2006

(51) Int. Cl.
*A47K 3/024* (2006.01)

(52) U.S. Cl. ..... 4/574.1

(58) Field of Classification Search ..... 4/571.1, 4/573.1, 574.1, 605, 606, 611; 15/104.92, 15/118, 160, 210.1, 244.1, 244.3
See application file for complete search history.

(56) References Cited

U.S. PATENT DOCUMENTS 5,228,151 A 7/1993 Livingston-Capoano
5,331,693 A 7/1994 Petersen et al.
5,340,070 A 8/1994 Soma
5,628,083 A * 5/1997 Hayes ..... 15/244.3
5,647,072 A 7/1997 Shaffer et al.
5,822,824 A * 10/1998 Dion ..... 15/210.1
D422,687 S 4/2000 Livingston-Capoano
6,115,857 A * 9/2000 Bidegain ..... 4/574.1
6,120,872 A 9/2000 Deshon
6,370,722 B1 * 4/2002 Duckworth ..... 15/104.92
6,453,485 B2 9/2002 Bullock

* cited by examiner

*Primary Examiner*—Huyen Le

(57) ABSTRACT

A foot support for supporting a foot of a person and inhibiting slipping of the foot down a wall when the person is shaving a leg includes a base plate being mountable to a wall of a shower. A mounting system is coupled to the base plate. The mounting system engages the wall to mount the base plate to the wall. A foot pad is coupled to the base plate opposite the mounting system. The foot pad receives the foot to support the foot and inhibit the foot from sliding along the wall.

18 Claims, 6 Drawing Sheets

FOOT SUPPORT

BACKGROUND OF THE INVENTION

1. Field of the Invention

The present invention relates to footrests and more particularly pertains to a new footrest for supporting a foot of a person and inhibiting slipping of the foot down a wall when the person is shaving a leg.

2. Description of the Prior Art

The use of footrests is known in the prior art. The prior art commonly teaches the footrest being of rigid construction with a friction enhancing coating to inhibit slipping of a foot positioned on the footrest.

While these devices fulfill their respective, particular objectives and requirements, the need remains for a device that has certain improved features that cushions a foot positioned in the device while inhibiting slipping of the foot from the device. Additionally, the device includes a receiving ring and a basket to hold items commonly used in shaving.

SUMMARY OF THE INVENTION

The present invention meets the needs presented above by generally comprising a base plate being mountable to a wall of a shower. A mounting system is coupled to the base plate. The mounting system engages the wall to mount the base plate to the wall. A foot pad is coupled to the base plate opposite the mounting system. The foot pad receives the foot to support the foot and inhibit the foot from sliding along the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
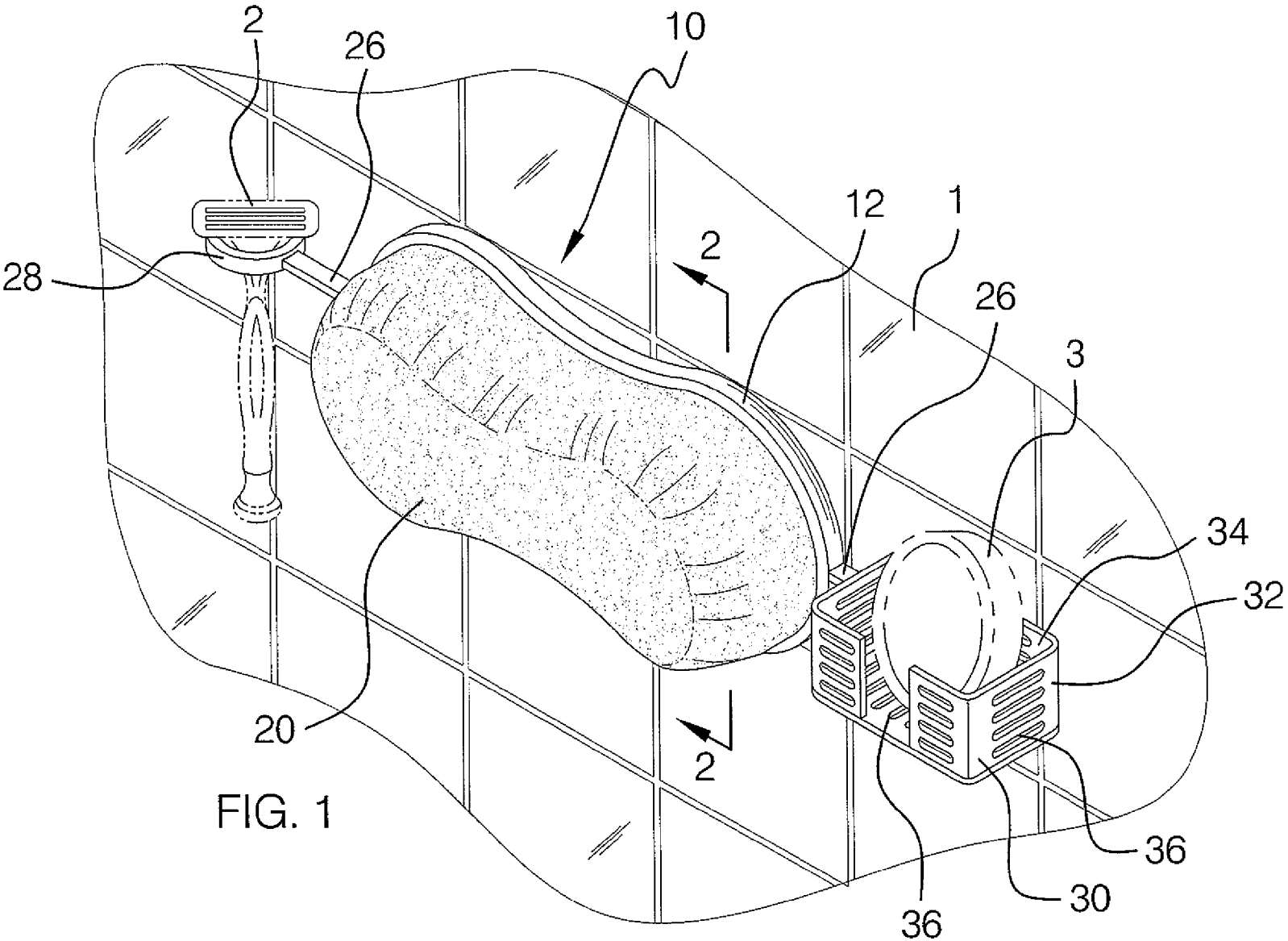
FIG. 1 is a perspective view of a foot support according to the present invention mounted to a wall.
Figure 2:
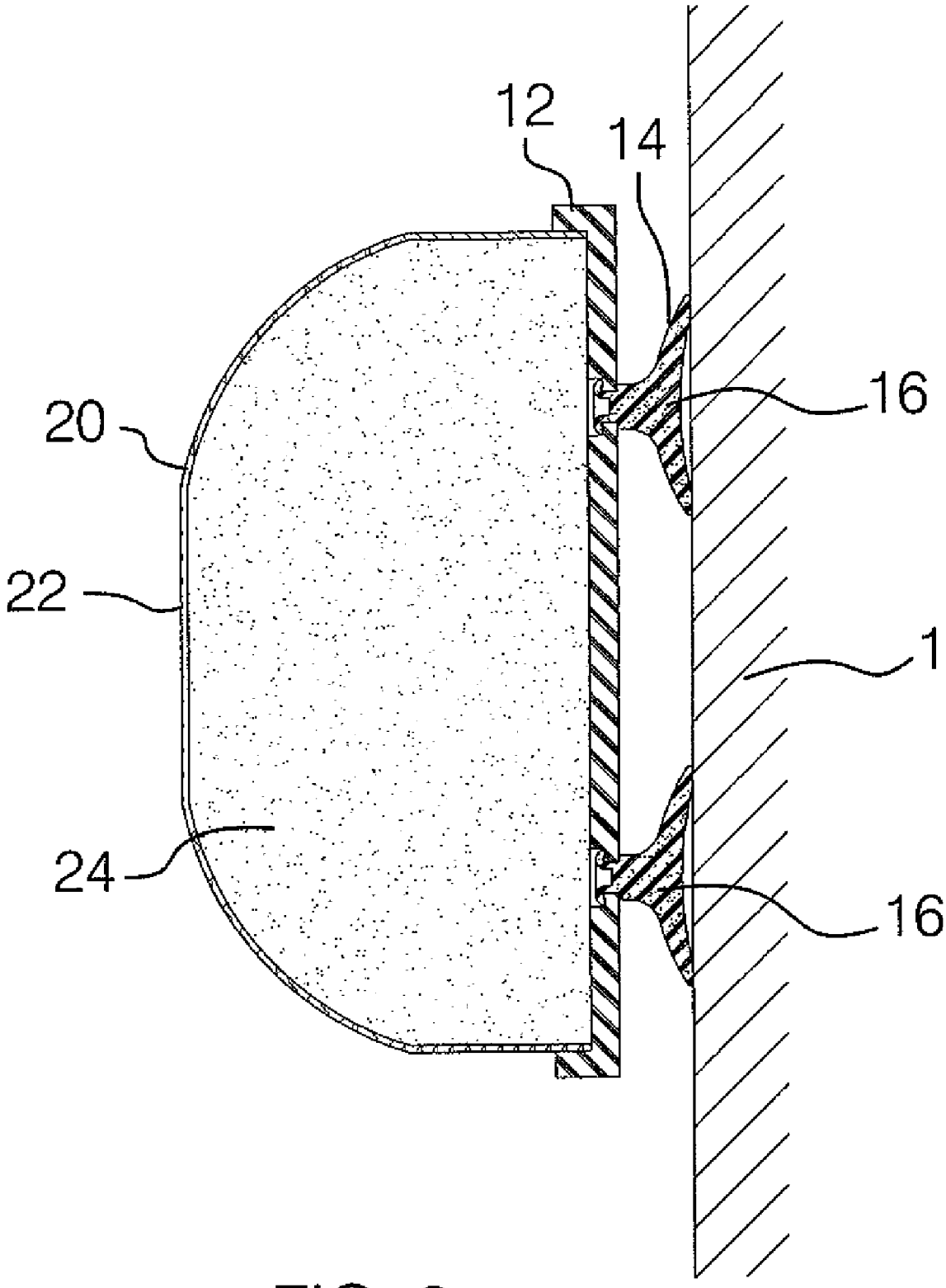
FIG. 2 is a cross-sectional view of the present invention taken along line 2-2 of FIG. 1.
Figure 3:
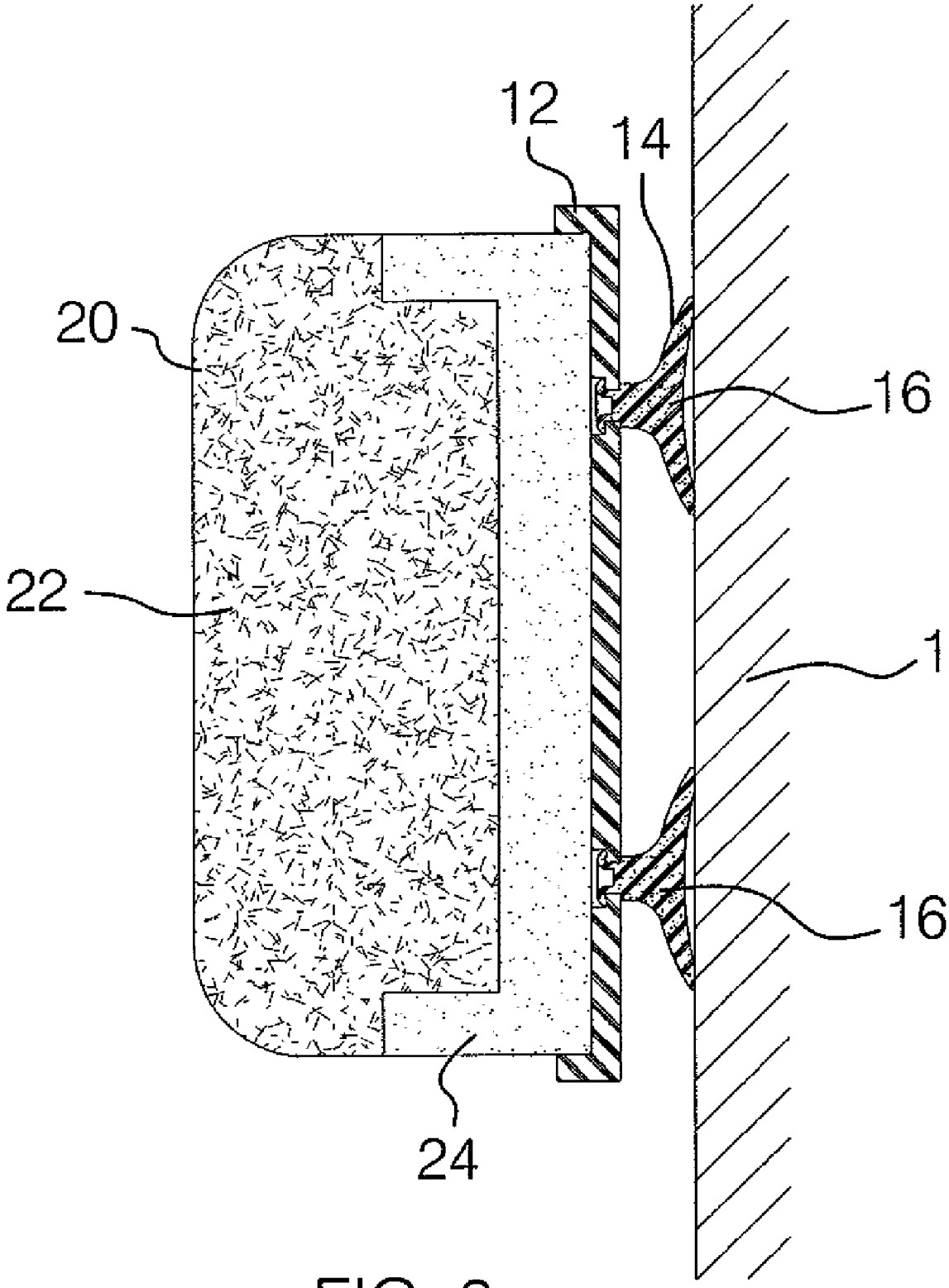
FIG. 3 is a cross-sectional view of an embodiment of the foot pad of the present invention shown in FIG. 2.
Figure 4:
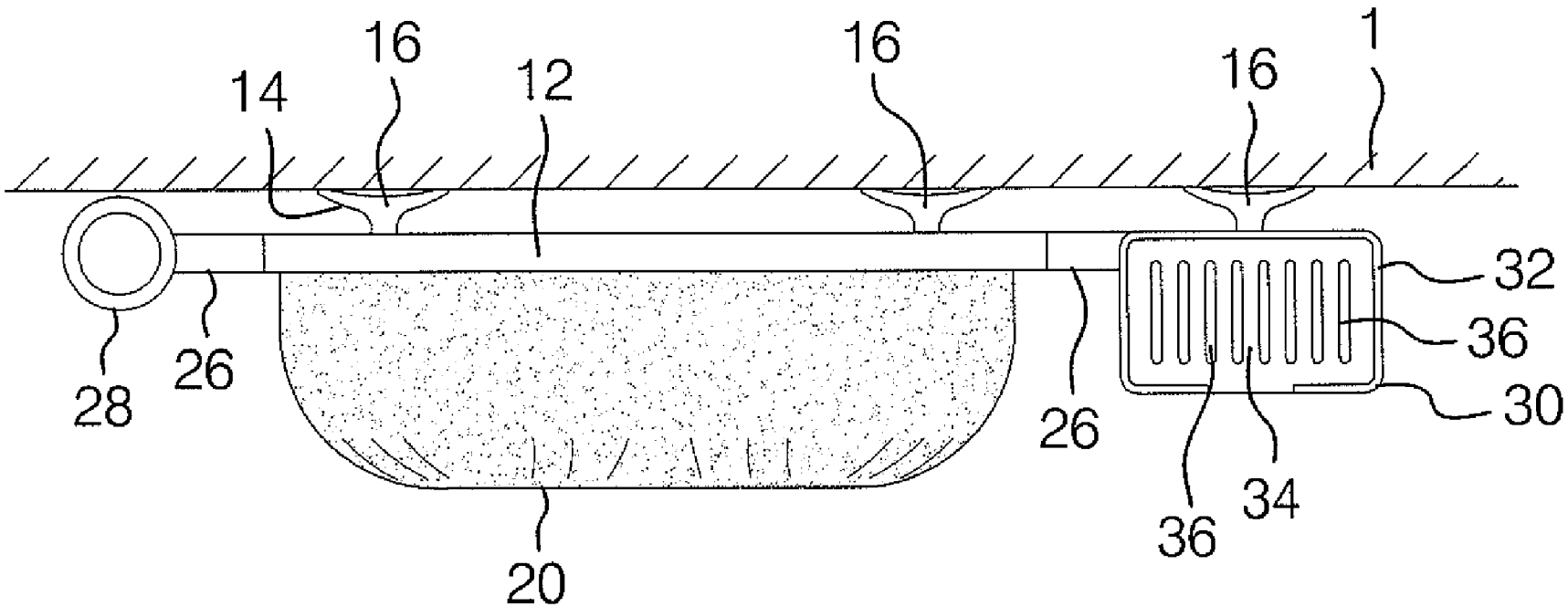
FIG. 4 is a top view of the present invention.
Figure 5:
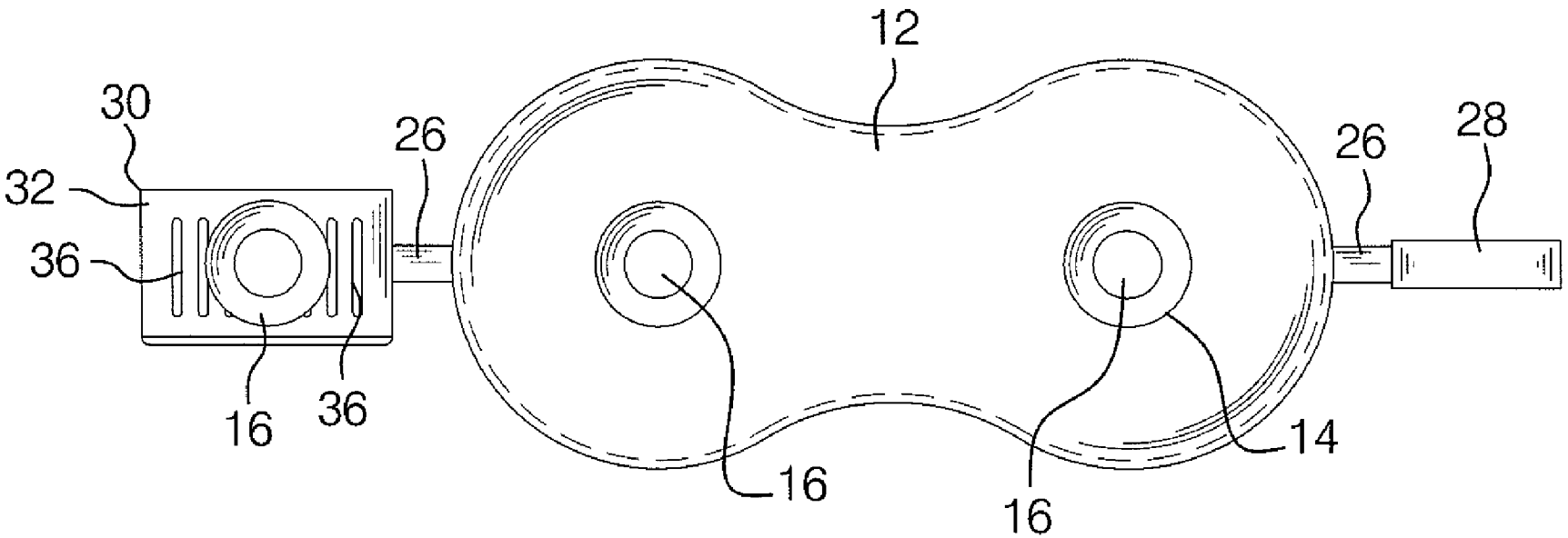
FIG. 5 is a rear view of the present invention.

With reference now to the drawings, and in particular to FIGS. 1 through 6 thereof, a new footrest embodying the principles and concepts of the present invention and generally designated by the reference numeral 10 will be described.

Figure 6:
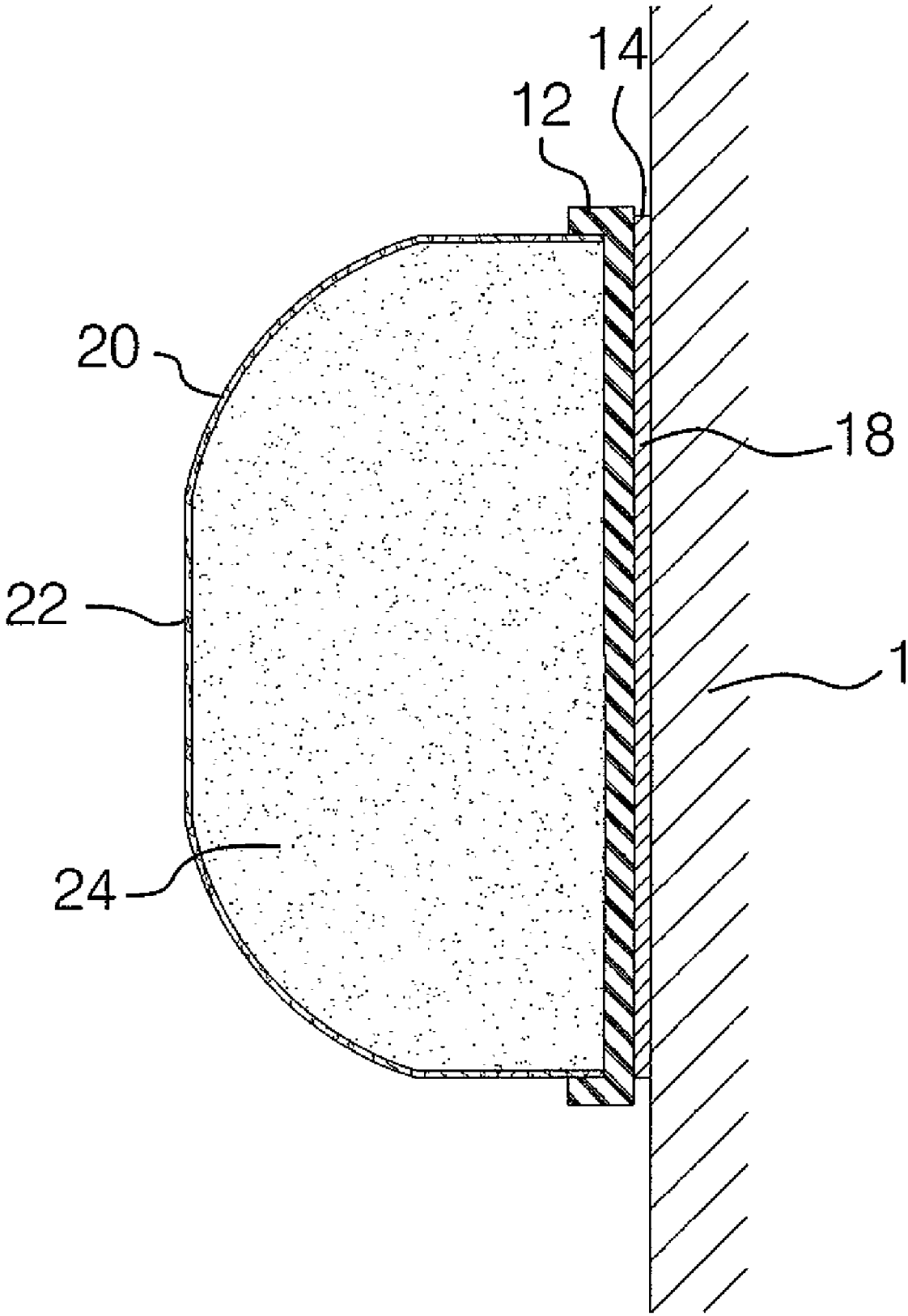
FIG. 6 is a cross-sectional view of an embodiment of the present invention shown in FIG. 2.

As best illustrated in FIGS. 1 through 6, the foot support 10 generally comprises a base plate 12 being mountable to a wall 1 of a shower. A mounting system 14 is coupled to the base plate 12. The mounting system 14 engages the wall 1 to mount the base plate 12 to the wall 1. The mounting system 14 includes a plurality of suction cups 16 coupled to and extending outwardly from the base plate 12. Each of the suction cups 16 is pressed against the wall 1 to create suction between the suction cups 16 and the wall 1 to secure the suction cups 16 to the wall 1. In an embodiment, as shown in FIG. 6, the mounting system 14 includes an adhesive layer 18 coupled to the base plate 12. The adhesive layer 18 releasably adheres to the wall 1 to mount the base plate 12 to the wall 1.

A foot pad 20 is coupled to the base plate 12 opposite the mounting system 14. The foot pad 20 receives a foot to support the foot and inhibit the foot from sliding along the wall 1. The foot pad 20 includes an outer portion 22 and an inner portion 24. The inner portion 24 is coupled to the base plate 12 and extends outwardly from the base plate 12. The inner portion 24 is comprised of a resiliently flexible material to cushion the foot positioned on the foot pad 20. The outer portion 22 is coupled to the inner portion 24 opposite the base plate 12. The outer portion 22 is comprised of a friction enhancing material to increase friction between the foot pad 20 and the foot to inhibit slipping of the foot off of the foot pad 20.

Each of a pair of arms 26 is coupled to and outwardly extends from the base plate 12. The arms 26 extend in opposite directions with respect to each other. Each of the arms 26 is aligned with a longitudinal axis of the base plate 12. Each of the arms 26 is parallel with a plane of the wall 1. A receiving ring 28 is coupled to one of the arms 26 opposite the base plate 12. The receiving ring 28 receives a portion of a razor 2 to allow the razor 2 to be supported by the receiving ring 28.

A basket 30 is coupled to one of the arms 26 opposite the base plate 12. The basket 30 receives a lather source 3 to support the lather source 3. The basket 30 includes a perimeter wall 32 defining an interior space 34 of the basket 30. The interior space 34 receives the lather source 3 when the lather source 3 is not in use. The perimeter wall 32 has at least one aperture 36 to permit liquid to drain from the basket 30. One of the suction cups 16 of the mounting system 14 is coupled to the basket 30 and extends between the basket 30 and the wall 1 to provide additional support to the basket 30 when the suctions cups 16 engage the wall 1.

In use, the mounting system 14 is engaged to the wall 1 to secure the foot pad 20 to the wall 1. As a person shaves their leg the foot is positioned on the foot pad 20 to inhibit the foot from sliding down the wall 1 when the person is shaving their leg. The razor 2 is positioned in the receiving ring 28 to facilitate access to the razor 2 when the foot is positioned on the foot pad 20. A lather source 3 is positioned in the basket 30 so that the lather source 3 can be easily reached to lather the leg when the foot is positioned on the foot pad 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot support to support a foot during while a person shaves their leg, said device comprising:

a base plate being mountable to a wall of a shower;

a mounting system being coupled to said base plate, said mounting system engaging the wall to mount said base plate to the wall;

a foot pad being coupled to said base plate opposite said mounting system, said foot pad receiving the foot to support the foot and inhibit the foot from sliding along the wall;

a pair of arms, each of said arms being coupled to and outwardly extending from said base plate, said arms extending in opposite directions with respect to each other; and a receiving ring being coupled to one of said arms opposite said base plate, said receiving ring receiving a portion of a razor to allow the razor to be supported by said receiving ring.

2. The support according to claim 1, wherein said mounting system includes a plurality of suction cups coupled to and extending outwardly from said base plate, each of said suction cups being pressed against the wall to create suction between said suction cups and the wall to secure said suction cups to the wall.

3. The device according to claim 1, wherein said mounting system includes an adhesive layer being coupled to said base plate, said adhesive layer releasably adhering to the wall to mount said base plate to the wall.

4. The support according to claim 1, wherein said foot pad includes an inner portion, said inner portion being coupled to said base plate and extending outwardly from said base plate, said inner portion being comprised of a resiliently flexible material to cushion the foot positioned on said foot pad.

5. The support according to claim 4, wherein said foot pad includes an outer portion, said outer portion being coupled to said inner portion opposite said base plate, said outer portion being comprised of a friction enhancing material to increase friction between said foot pad and the foot to inhibit slipping of the foot off of said foot pad.

6. The support according to claim 1, wherein each of said arms is aligned with a longitudinal axis of said base plate, each of said arms being parallel with a plane of the wall.

7. The support according to claim 1, further comprising a basket being coupled to one of said arms opposite said base plate, said basket receiving a lather source to support the lather source.

8. The support according to claim 7, wherein said basket includes a perimeter wall defining an interior space of said basket, said interior space receiving the lather source when the lather source is not in use.

9. The support according to claim 8, wherein said perimeter wall has at least one aperture to permit liquid to drain from said basket.

10. A foot support to support a foot during while a person shaves their leg, said device comprising:

a base plate being mountable to a wall of a shower;

a mounting system being coupled to said base plate, said mounting system engaging the wall to mount said base plate to the wall, said mounting system including a plurality of suction cups coupled to and extending outwardly from said base plate, each of said suction cups being pressed against the wall to create suction between said suction cups and the wall to secure said suction cups to the wall;

a foot pad being coupled to said base plate opposite said mounting system, said foot pad receiving the foot to support the foot and inhibit the foot from sliding along the wall, said foot pad including an outer portion and an inner portion, said inner portion being coupled to said base plate and extending outwardly from said base plate, said inner portion being comprised of a resiliently flexible material to cushion the foot positioned on said foot pad, said outer portion being coupled to said inner portion opposite said base plate, said outer portion being comprised of a friction enhancing material to increase friction between said foot pad and the foot to inhibit slipping of the foot off of said foot pad;

a pair of arms, each of said arms being coupled to and outwardly extending from said base plate, said arms extending in opposite directions with respect to each other, each of said arms being aligned with a longitudinal axis of said base plate, each of said arms being parallel with a plane of the wall;

a receiving ring being coupled to one of said arms opposite said base plate, said receiving ring receiving a portion of a razor to allow the razor to be supported by said receiving ring; and a basket being coupled to one of said arms opposite said base plate, said basket receiving a lather source to support the lather source, said basket including a perimeter wall defining an interior space of said basket, said interior space receiving the lather source when the lather source is not in use, said perimeter wall having at least one aperture to permit liquid to drain from said basket, one of said suction cups of said mounting system being coupled to said basket and extending between said basket and the wall to provide additional support to said basket when said suctions cups engage the wall.

11. A foot support to support a foot during while a person shaves their leg, said device comprising:

a base plate being mountable to a wall of a shower;

a mounting system being coupled to said base plate, said mounting system engaging the wall to mount said base plate to the wall;

a foot pad being coupled to said base plate opposite said mounting system, said foot pad receiving the foot to support the foot and inhibit the foot from sliding along the wall;

a pair of arms, each of said arms being coupled to and outwardly extending from said base plate, said arms extending in opposite directions with respect to each other; and a basket being coupled to one of said arms opposite said base plate, said basket receiving a lather source to support the lather source.

12. The support according to claim 11, wherein said mounting system includes a plurality of suction cups coupled to and extending outwardly from said base plate, each of said suction cups being pressed against the wall to create suction between said suction cups and the wall to secure said suction cups to the wall.

13. The device according to claim 11, wherein said mounting system includes an adhesive layer being coupled to said base plate, said adhesive layer releasably adhering to the wall to mount said base plate to the wall.

14. The support according to claim 11, wherein said foot pad includes an inner portion, said inner portion being coupled to said base plate and extending outwardly from said base plate, said inner portion being comprised of a resiliently flexible material to cushion the foot positioned on said foot pad.

15. The support according to claim 14, wherein said foot pad includes an outer portion, said outer portion being coupled to said inner portion opposite said base plate, said outer portion being comprised of a friction enhancing material to increase friction between said foot pad and the foot to inhibit slipping of the foot off of said foot pad.

16. The support according to claim 11, wherein each of said arms is aligned with a longitudinal axis of said base plate, each of said arms being parallel with a plane of the wall.

17. The support according to claim 11, wherein said basket includes a perimeter wall defining an interior space of said basket, said interior space receiving the lather source when the lather source is not in use.

18. The support according to claim 17, wherein said perimeter wall has at least one aperture to permit liquid to drain from said basket.

* * * * *